US011566812B2

(12) United States Patent
Lindborg

(10) Patent No.: US 11,566,812 B2
(45) Date of Patent: Jan. 31, 2023

(54) SELF-ADJUSTED SUPPLY AIR TERMINAL

(71) Applicant: LINDINVENT AB, Lund (SE)

(72) Inventor: Herman Lindborg, Skiffervagen (SE)

(73) Assignee: LINDINVENT AB, Lund (SE)

( * ) Notice: Subject to any disclaimer, the term of this patent is extended or adjusted under 35 U.S.C. 154(b) by 213 days.

(21) Appl. No.: 16/496,322

(22) PCT Filed: Mar. 9, 2018

(86) PCT No.: PCT/SE2018/050226

§ 371 (c)(1),
(2) Date: Sep. 20, 2019

(87) PCT Pub. No.: WO2018/174776

PCT Pub. Date: Sep. 27, 2018

(65) Prior Publication Data

US 2020/0033023 A1 Jan. 30, 2020

(30) Foreign Application Priority Data

Mar. 21, 2017 (EP) ..... 17161972

(51) Int. Cl.
*F24F 13/06* (2006.01)
*F24F 13/02* (2006.01)
*F24F 13/14* (2006.01)

(52) U.S. Cl.
CPC ..... *F24F 13/1413* (2013.01); *F24F 13/06* (2013.01); *F24F 2221/14* (2013.01)

(58) Field of Classification Search
USPC ..... 454/349, 353, 359, 360, 304; 137/527.6
See application file for complete search history.

(56) References Cited

U.S. PATENT DOCUMENTS 3,126,811 A * 3/1964 Kennedy ..... F24F 13/072 454/304
3,285,155 A * 11/1966 Maltenfort ..... F24F 13/08 454/359

(Continued)

FOREIGN PATENT DOCUMENTS

DE 4010134 A1 10/1990
DE 29822930 U1 2/1999

(Continued)

OTHER PUBLICATIONS

JP2002089913A_Description_202106081251, Machine translation of JP 2002089913, Kawaguchi, from Espacenet (Year: 2002).*

(Continued)

*Primary Examiner* — Steven B McAllister
*Assistant Examiner* — Cole N Friedman
(74) *Attorney, Agent, or Firm* — The Marbury Law Group PLLC

(57) ABSTRACT

A supply air terminal (10) is provided, comprising a wall member (11) surrounding an opening (110); a deflector (12) connected at a distance from the wall member to face the opening, thereby forming an annular aperture (13) between the wall member and the deflector; and a plurality of flaps (14) pivotably connected at a hinge (15) to the wall member to hang down in the annular aperture such that an open slit (16) is formed between an edge (142) of each flap and the deflector, wherein the slit has a width which is self-adjusted by means of the flaps pivoting under influence of the airflow through the terminal.

15 Claims, 5 Drawing Sheets

(56) References Cited

U.S. PATENT DOCUMENTS

| | | | | | |
|---|---|---|---|---|---|
| 5,107,755 | A * | 4/1992 | Leban | F24F 13/06 | 454/302 |
| 5,277,658 | A | 1/1994 | Goettl | | |
| 5,498,204 | A * | 3/1996 | Anderson | E04D 13/152 | 454/30 |
| 6,176,777 | B1 * | 1/2001 | Smith | F24F 13/062 | 454/256 |
| 2015/0314338 | A1 * | 11/2015 | Morioka | G03F 7/30 | 137/861 |
| 2016/0108925 | A1 * | 4/2016 | Huang | F24F 7/007 | 415/121.3 |

FOREIGN PATENT DOCUMENTS

| | | | | |
|---|---|---|---|---|
| EP | 3156738 | A1 | | 4/2017 |
| GB | 572785 | A | | 10/1945 |
| JP | 10197042 | A | | 7/1998 |
| JP | 2002089913 | A | * | 3/2002 |
| JP | 2002089913 | A | | 3/2002 |
| JP | 2008070073 | A | | 3/2008 |
| WO | 2015189992 | A1 | | 12/2015 |

OTHER PUBLICATIONS

Extended European Search Report for Application No. 17161972.9 dated Sep. 27, 2017, 7 pages.
International Search Report and Written Opinion for Application No. PCT/SE2018/050226, dated Aug. 1, 2018.

* cited by examiner

SELF-ADJUSTED SUPPLY AIR TERMINAL

PRIORITY CLAIM

This application is a 35. U.S.C. § 371 national phase of PCT/SE2018/050226 filed Mar. 9, 2018; which application claims priority from European Application No. 17161972.9 filed Mar. 21, 2019. The above-referenced applications are hereby incorporated by reference in their entireties as if fully set forth herein.

TECHNICAL FIELD

The invention relates to the field of devices for distribution of airflows. More specifically, the invention pertains to the field of supply air terminals for distribution of air in different types of spaces, configured so as to provide a suitable velocity of distributed air, when the air is supplied to the terminal at various different flows, such that the distributed air mix suitably with the existing atmosphere in the room or space in question.

BACKGROUND

Ventilation and provision of airflows of variable degree may be employed in any type of building space, such as in a home environment. More notably, the requirements for suitable ventilation are particularly relevant for public buildings and commercial spaces, where there occasionally may be many people, and in other types of spaces where requirements for e.g. temperature, humidity, oxygen level etc. may be important.

In order to save energy in large commercial and public buildings, ventilation systems with variable airflow may be employed, which operate with cooled air of e.g. 15-18 degrees Celsius. Savings are obtained by heating of the air inside the room to which the airflow is provided, by means of people, lighting, computers and other electronic devices and even animals present therein.

An important feature is that the supply air is conveniently spread in the room without causing draught, which could be experienced as uncomfortable and potentially damaging. One way of obtaining this is to provide air from an air terminal, such that cooled fresh air is propelled along the ceiling of a room. This way, hotter air already present in the room will be pulled up by the airflow and be purposefully mixed with the cooled fresh air already within a short distance from the terminal.

General requirements on an air terminal is a low level of noise generation, as caused by flowing air. Furthermore, the air terminal must in many applications be able to operate with very low flows, such as 5-40 l/s (liters per second). During the winter season in countries where the climate provides temperatures that are way below normal room temperature, air may oftentimes be supplied within low ranges of e.g. 10-20 l/s, due to the additional cooling of the room through walls and windows.

Presently, supply air terminals with a fixed opening dominate the market, due to lower cost for manufacturing than terminals with a controllably regulated opening. Such terminals are most often configured with opening dimensioned to provide a low level of noise at high flows. As a consequence, there may often be problems with draught, by means of dropping cold air, at low flows. At any rate, a supply air terminal with a fix opening will generally work far from optimally at either high flows or low flows.

WO02/35157 presented a solution for an air terminal with a controlled valve function for variable flows, comprising a tube with an output opening and a deflector surface facing the output opening for regulation of the air flow by means of an actuator for variable setting of the distance between the deflector surface the output end. The device was further provided with discs in the output opening, forming separate fluid passages arranged in parallel to each other with a narrow width over an extended flow distance to promote laminar flow with low noise generation.

WO03/001124 provided a combined fire damper and air terminal, with a shutter that opens a gap progressively as the flow increases, for the purpose of avoiding cold zones. The presented solution is not suitable for operation at high flows, though, as it will generate a high level of noise by design, and an unsatisfactory ejection of air along the ceiling.

U.S. Pat. No. 4,508,022 disclosed a ceiling air outlet, which has at least two flow paths before an outlet grate. One comprises a series of jet openings at a peripheral portion of the device, directed toward the outlet grate, providing a flow path for low level airflow. A second flow path is provided radially inwardly of the jet openings, where an adjustment flap is located which is configured to open up to allow for air passage at higher flows. The device is characterized by its complexity in terms of design and manufacture.

WO2015/189992 suggests a ceiling cassette air conditioner which includes an external case attached to a lower side of a ceiling-embedded casing, and forming an air inlet with the ceiling, an external panel attached to a lower side of the external case, having an air blower and a heat exchanger inside, and forming an air outlet with the external case to discharge conditioned air in a ceiling-parallel direction. The device includes wind direction adjusting vanes provided on an outer periphery of the external panel to adjust a discharge direction of the conditioned air discharged from the air outlet. During operation, the wind direction adjusting vanes are turned in a clockwise and counterclockwise direction from a reference position by means of a drive source such as a motor.

DE4010134 discloses an air supply unit for air conditioning of rooms, having a distributor housing for mounting in the ceiling. On the underside of this housing are one or more lateral primary air nozzles and also a central air outlet with an air-deflector body. The primary nozzles may be adjustable, while the body can be of the swirl-inducing type, mounted in a vertical guide tube, and adjustment may typically be accomplished by means of a servo motor.

None of these devices offer a solution suitable for regulation of air distribution to different spaces which is compatible with existing ventilation installations. More specifically, there is still exists a need for a device for controlled distribution of air which is both cost-effective and capable of regulating air distribution at various air flows, which may be both high and low flow levels supplied from a ventilation system, such that suitable mixing with the surrounding air is obtained.

SUMMARY

In order to target the drawbacks and objectives of the state of the art, a supply air terminal according to claim 1 is provided.

According to one aspect, this relates to a supply air terminal, comprising a wall member surrounding an opening; a deflector connected at a distance from the wall member to face the opening, thereby forming an annular aperture between the wall member and the deflector; a plurality of flaps pivotably connected at a hinge to the wall member to hang down in the annular aperture such that an open slit is formed between an edge of each flap and the deflector, wherein the slit has a width which is self-adjusted by means of the flaps pivoting under influence of the airflow through the terminal.

In one embodiment, said flaps are pivotable between a relaxed position and a high flow position, wherein the flap edges are arranged radially inwardly of a perimeter of the deflector and at a first distance from the deflector in at least the relaxed position.

In one embodiment, the flap edges are arranged radially outwardly of the perimeter of the deflector in the high flow position.

In one embodiment, an outwards projecting flange is formed at an outer end of the wall member, which flange extends in a plane about the opening.

In one embodiment, wherein an outer portion of the deflector is parallel to, and spaced apart outwardly of, the projecting flange.

In one embodiment, the opening formed by the wall member has a cross-section which increases from a position of said hinge towards said projecting flange.

In one embodiment, each flap has a balancing portion for calibrating the position of center of gravity for the flap with respect to the position of the hinge.

In one embodiment, said hinge comprises an aperture formed in the flap and a hinge member projecting from the wall member into the aperture, such that the flaps rests with an edge of the aperture against the projecting hinge member.

In one embodiment, said hinge member is a bent portion extending from the wall member.

In one embodiment, the wall member and the flange are formed from a single sheet of metal.

In one embodiment, said hinge member is formed from said single sheet of metal.

In one embodiment, said wall member has two pairs of opposing wall sides, providing a rectangular shape to the opening, the terminal comprising four flaps hinged to respective wall sides.

In one embodiment, said wall member has a cylindrical wall side, providing a circular shape to the opening, the terminal comprising three or more flaps hinged to the wall side at evenly distributed positions around the opening.

In one embodiment, said deflector is a flat sheet, detachably connectable to the wall member.

In one embodiment, each flap is made from a flat sheet of plastic.

BRIEF DESCRIPTION OF THE DRAWINGS

Various aspects associated with the invention will be described below with reference to the accompanying drawings, on which FIG. 1 schematically illustrates a cross-sectional view an embodiment of an air supply terminal for ceiling mounting, self-adjusted for low level airflow.

DETAILED DESCRIPTION OF EMBODIMENTS

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout. Well-known functions or constructions may not be described in detail for brevity and/or clarity. Unless otherwise defined, all terms, including technical and scientific terms, used herein have the same meaning as commonly understood by one of ordinary skill in the art to which this invention belongs.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

The general composition and function of an embodiment of the supply air terminal 10, also referred to as just terminal 10 for short herein, will now be described with reference to FIGS. 1-4.

Figure 1:
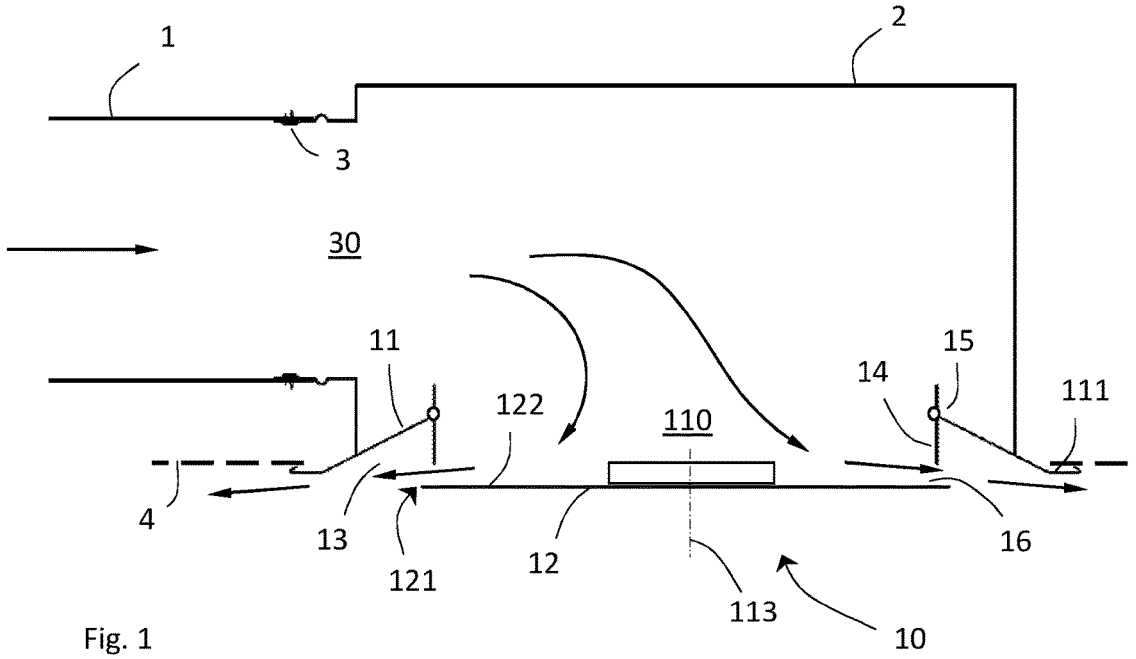

FIG. 1 presents an implementation of air supply terminal according to an embodiment, assembled in connection with ventilation system. The air supply terminal as presented herein by means of embodiments is not configured for control of the flow level of air in itself. Rather, the function of the supply air terminal is to provide suitable provision of air to a connecting room dependent on the airflow level provided to the terminal. FIG. 1 illustrates a supply duct 1 of a ventilation system, connected to a box 2 at an interface 3. Normally, the box 2 is provided just above the inner ceiling 4 of a room, as are at least parts of the supply ducts 1. The box 2 has an opening at its lower side for connection to a supply air terminal 10, and is preferably otherwise sealed. A valve device for regulation of the airflow (not shown) may be arranged in the box 2, for regulating the airflow provided to the terminal 10. Alternatively, a device for regulating the airflow may be provided upstream in the duct 1 or farther away.

Figure 2:
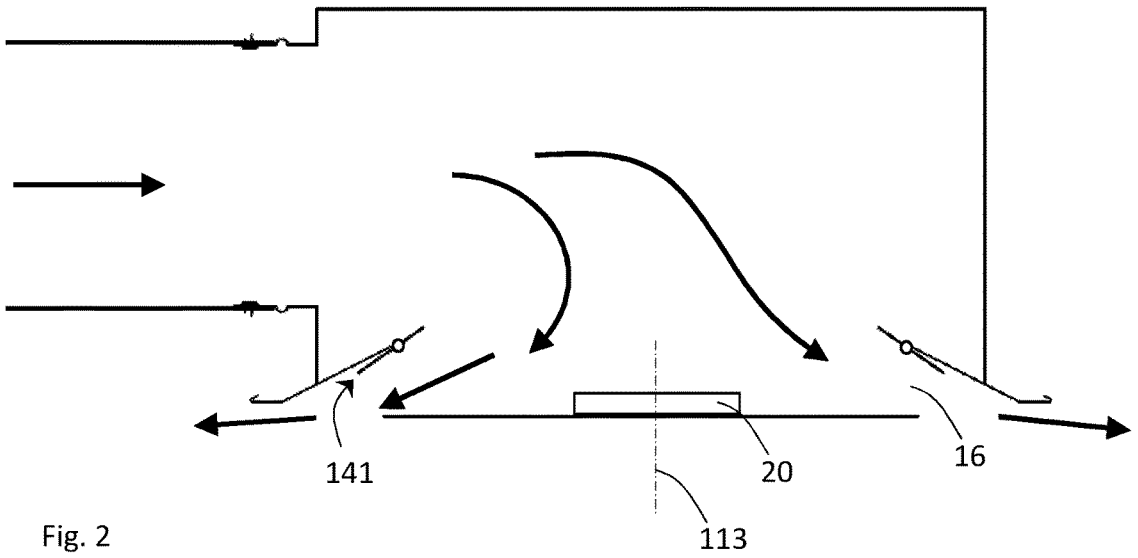
FIG. 2 schematically illustrates the embodiment of FIG. 1, self-adjusted for high level airflow.
Figure 3A:
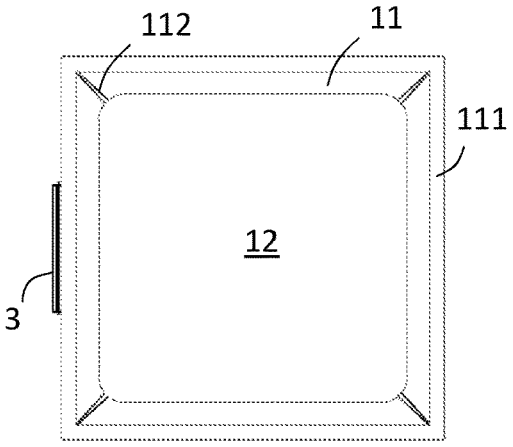
FIG. 3 illustrates various views of an embodiment of an air supply terminal connected to an air supply chamber, for connection to an air supply duct.
Figure 3B:
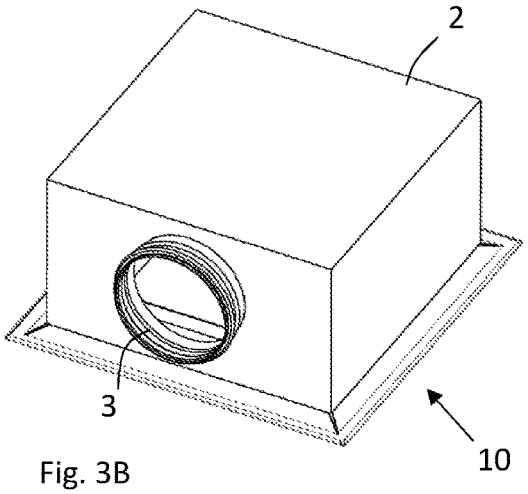
Figure 3C:
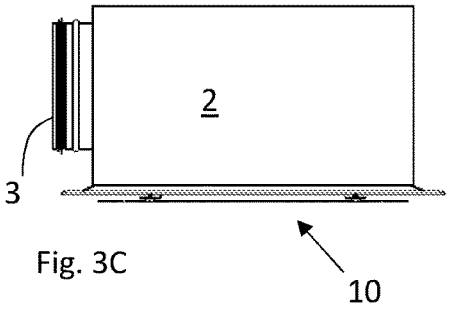
Figure 3D:
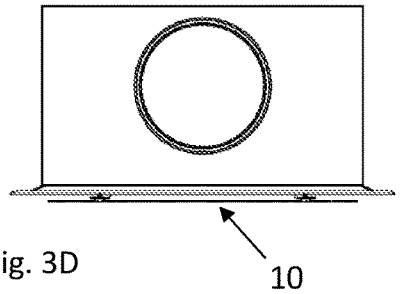

FIG. 2 illustrates the same embodiment as in FIG. 1, but in a setting for a different airflow level, as will be described. For the purpose of minimizing the cluttering of the drawings, some reference numerals are provided in FIG. 1 and some in FIG. 2, but they shall be understood as referring to the corresponding elements in any of these two drawings. In fact, the same reference numerals are used throughout the drawings to indicate the same or corresponding elements and features, for the sake of simplicity. FIG. 3 shows various perspective views of the terminal 10 assembled with a box 2, also indicating the interface 3 for mounting to a ventilation duct.

Figure 4A:
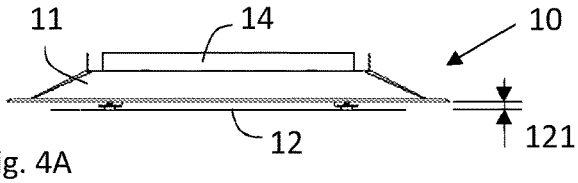
FIG. 4 illustrates various views of an embodiment of an air supply terminal applicable to the embodiments of FIGS. 1-3.
Figure 4B:
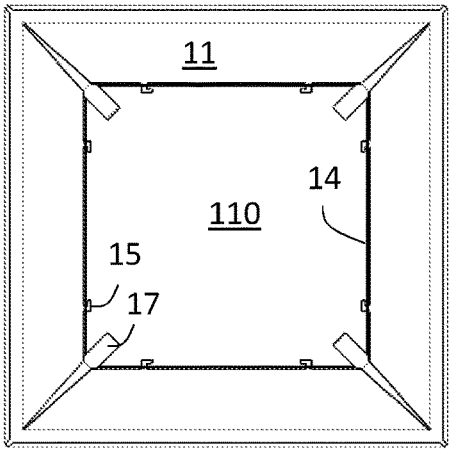
Figure 4C:
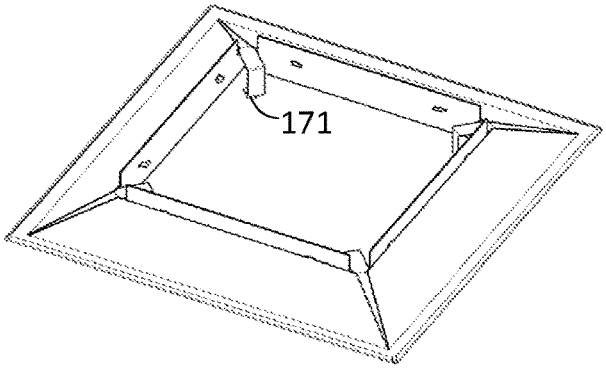

FIG. 4A illustrates a top view of the terminal 10, as seen from side of the box 2, and FIG. 4C shows the terminal 10 from a perspective view.

As can be seen in these drawings, the supply air terminal 10 comprises a wall member 11 which surrounds an opening 110. The opening 110 represents the output opening of the box 2, when the terminal is assembled to such a box 2. A deflector 12 is connected at a distance 121 from the wall member 11 to face the opening 110. Preferably, the deflector is arranged perpendicular to an axis 113 of the opening 110. An annular aperture 13 between the wall member 11 and the deflector 12 is thus formed, through which air may be supplied. The deflector 12 is preferably connected at a fixed distance from the wall member 11, but may be detachable by suitable means, as will be described.

The terminal 10 further comprises two or more flaps 14, which are pivotably connected to the wall member 11 by means of a hinge 15. The hinge 15 is schematically represented in FIGS. 1 and 2 by a small ring, but may be embodied on different ways, with examples being presented further below. The flaps are preferably freely suspended in the respective hinge 15 at a distance from the point of gravity for the flaps, so as to hang down by the force of gravity. When the terminal 10 is arranged with the deflector 12 substantially horizontally, such as when the terminal 10 is provided in a ceiling 4 arrangement, the flaps 14 may hang down towards the deflector 12 in the annular aperture 13, such that an open slit 16 is formed between an edge 142 of each flap 14 and the deflector 12. This is illustrated in FIG. 1 for a low airflow, or no airflow at all. In various embodiments, the terminal may be configured such that the flaps will hang down at low flow levels, e.g. up to 25 or 40 l/s. Such configuration or calibration may be determined on inter alia the weight of the respective flap, the position of the point of balance of the flaps in the hinges 15. So, in this rested arrangement, the flaps are arranged in their edges 141 in the most proximal position to the deflector, but they are not configured to close the aperture 13. Rather, a minimum slit opening 16 is defined by the length of the flap 14 from the hinge 15 to the edge 141, in relation to the position of the deflector with respect to the position of the hinge. The size of the minimum slit opening 16 may be in the range of 1-20 mm, e.g. in the range of 1-10 mm, 5-10 mm, 5-20 mm, or other. The size of the slit 16 may be selected dependent on inter alia the range of airflow level the terminal is deployed to provide in the particular ventilation installation, and the overall size of the aperture 13 as determined by its circumference. In one embodiment, the setting of the minimum slit opening 16 is accomplished by selection of a predetermined size of flap, which is suspended at the hinge 15 to a wall member 11 which is used for all installations of a particular dimension. This way, terminals 10 may be provided for a wide variety of operating conditions, with a major part of the installation members being used in common. As a result, production cost may be held low with a limited number of production tools, while assembly and installation may be conveniently performed.

The terminal 10 operates by increasing the cross-section of its outlet opening dependent on the level of airflow provided through the terminal 10. This is accomplished by the flaps 14 pivoting under influence of the airflow through the terminal 10, such that the slit 16 has a width which is self-adjusted to increase with the airflow. This is illustrated in FIG. 2, in which a higher airflow (illustrated by fatter arrows) is provided to the terminal 10. The flaps have then pivoted outwardly in the aperture 13, such that the slit 16 has increased considerably.

The described configuration of the terminal 10, where a small slit opening 16 is maintained for low flows, means that a comparatively high flow velocity out from the terminal 10 may nevertheless be accomplished in a ceiling 4 installation of a room. Furthermore, since the deflector 12 is connected at a distance or spacing 121 from the wall member 11, air will be ejected substantially horizontally out from the aperture 13 to spread along the ceiling 4, where it will conveniently mix with the air present in the room.

By means hinging the flaps 14 to the wall member 11 of the terminal 10, surrounding its opening 110, the slit opening will open up to a funnel shape for higher flows, as seen in FIG. 2. This way, generation of noise is minimized since the airflow will not primarily be throttled over an edge. At lower flows, when the flaps 14 hang down as in FIG. 1, noise generation will nevertheless not be a problem due to the comparatively low velocity of the airflow.

In a preferred embodiment, the flaps 14 are pivotable between the relaxed position as shown in FIG. 1 and a high flow position, and may preferably assume any position at least there between. In the relaxed position the flap edges 142 are preferably arranged radially inwardly of a perimeter 121 of the deflector 12, as shown in FIG. 1, at a first distance from the deflector representing the minimum slit opening 16. This may e.g. be accomplished by arranging the hinges 15 radially inwardly of the perimeter 121 of the deflector. By this arrangement, a flat outer portion 122 of the deflector within the perimeter 121, facing the opening 110, may also assist in guiding low level airflow in a horizontal direction out from the slit opening 16, rather than falling down, towards the surrounding ceiling 4.

In the high flow position as shown in FIG. 2, the terminal 10 may be configured such that the flap edges 142 are arranged radially outwardly of the perimeter 121 of the deflector 12. In an alternative embodiment (not shown) the deflector 12 may extend even further outwardly, such that its perimeter 121 is always arranged outwardly of the flap edges 142, even at high airflow.

In various embodiment, including the ones shown in the drawings, the supply air terminal 10 may be configured with an outwards projecting flange 111, formed at an outer end of the wall member 11, which flange 111 extends in a plane about the opening 110. The flange 111 may conveniently be configured for ceiling 4 mounting, wherein an upper side of the flange 111 forms a ceiling abutment.

As noted above, but which is more clearly seen in e.g. FIG. 4A, the outer portion 122 of the deflector 122 is preferably parallel to, and spaced apart outwardly of, the projecting flange 111 by a distance 121. Such an arrangement, where outer portion 122 of the deflector 12 and the flange 111 of the wall member 11 form spaced apart parallel surfaces, will assist in guiding air towards and along the ceiling 4 surrounding the terminal 10. The spacing 121 need in fact not be very large to obtain this benefit. A spacing of up to 20 mm, such as 5-15 mm, may be arranged to accomplish this guiding effect while still being substantially unnoticeable for persons in the room.

Tests on a terminal configured according to FIGS. 1-5 have shown that even at airflows of cool air as low as 4 l/s, the air will be ejected though the slit 16 in the rested position, and propelled along the ceiling to mix with the surrounding air that will be drawn up by the kinetic of the inlet air and heat the fresh air. Already about 1.5 m from the terminal 10 along the ceiling 4, inlet air at a temperature of 15 degrees has been heated to 21 degrees in an ambient atmosphere of 22 degrees.

The opening 110 formed by the wall member 11 preferably has a cross-section which increases from a position of the hinge 15 towards the projecting flange 111. This allows room for the hinges to pivot outwardly. In the drawings, the wall member 11 is angled to accomplish this increasing cross-section, e.g. by 30 degrees from horizontal. Since the flaps 14 form the outer perimeter of the opening through which air is ejected, the particular shape of the wall member 11 may be different than the straight wall funnel shape of the drawings for various alternative embodiments.

Figure 5A:
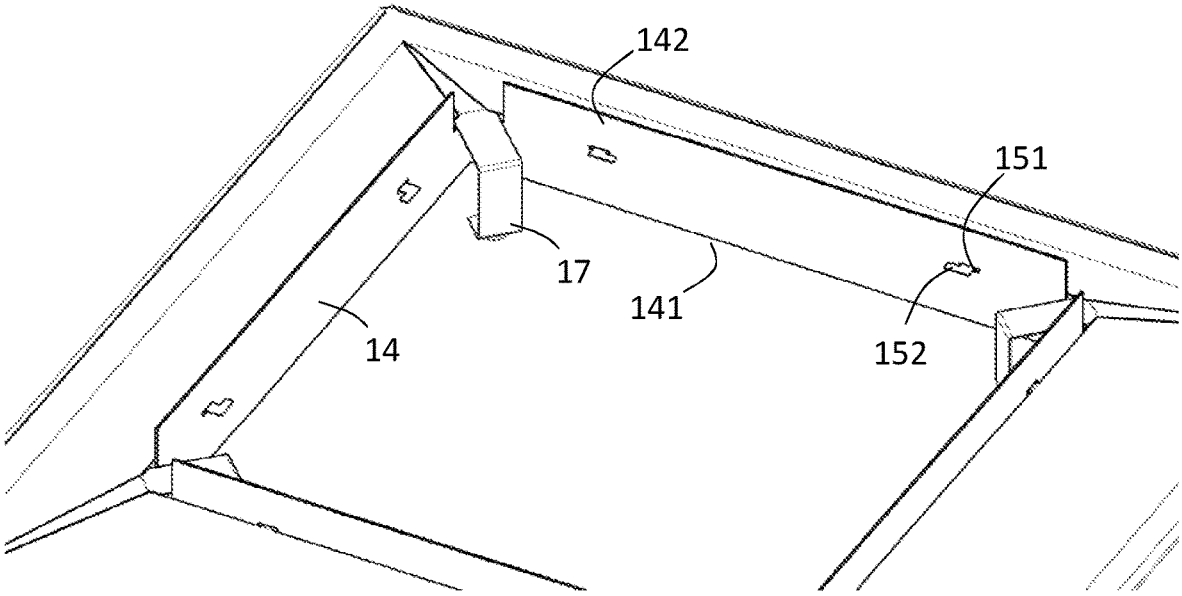
FIG. 5 illustrates perspective views of the air supply terminal of FIG. 4, as adjusted for different flow levels.

Turning to FIGS. 5A and B, which conveniently show enlarged portions of an embodiment of the terminal 10 from a perspective view, it may be seen that each flap 14 extends in a first direction from the hinge 15 to the flap edge 141, i.e. downwardly in the rested position of the flap 14. Furthermore, a balancing portion 142 may be connected to the flap 14, extending in a second direction from the hinge 15 to calibrate the position of center of gravity for the flap 14 with respect to the position of the hinge 15. This may be provided to minimize or calibrate the required rotation force for pivoting the flap 14. Dependent on which levels of airflow the terminal 10 is to be used for in a certain installation, a flap 14 of selected character in terms of size but also balance point may be selected and hinged to the wall member 11. Furthermore, the balancing portion 142 may be conveniently cut off to a selected degree, or be provided with an added weight e.g. by clamping or gluing, so recalibrate the point of balance of the flap 14. In one embodiment, the balancing portion 142 is an extension of the flap from a position of the hinge in a direction opposite to the flap edge 141. In such an embodiment, the flaps may be provided with a hinge aperture 151 at between 55 and 70% of the height of the flap, such as at 60% of the height.

In one embodiment, the hinge 15 comprises an aperture 151 formed in the flap 14 and a hinge member 152 projecting from the wall member 11 into the aperture 151. The flap is thereby suspended by resting with an edge of the aperture 151 against the projecting hinge member 152. This means that there will be a very small point of contact between the flap 14 and the wall member 11, which will assist in minimizing the required force for pivoting the flap 14.

Figure 5B:
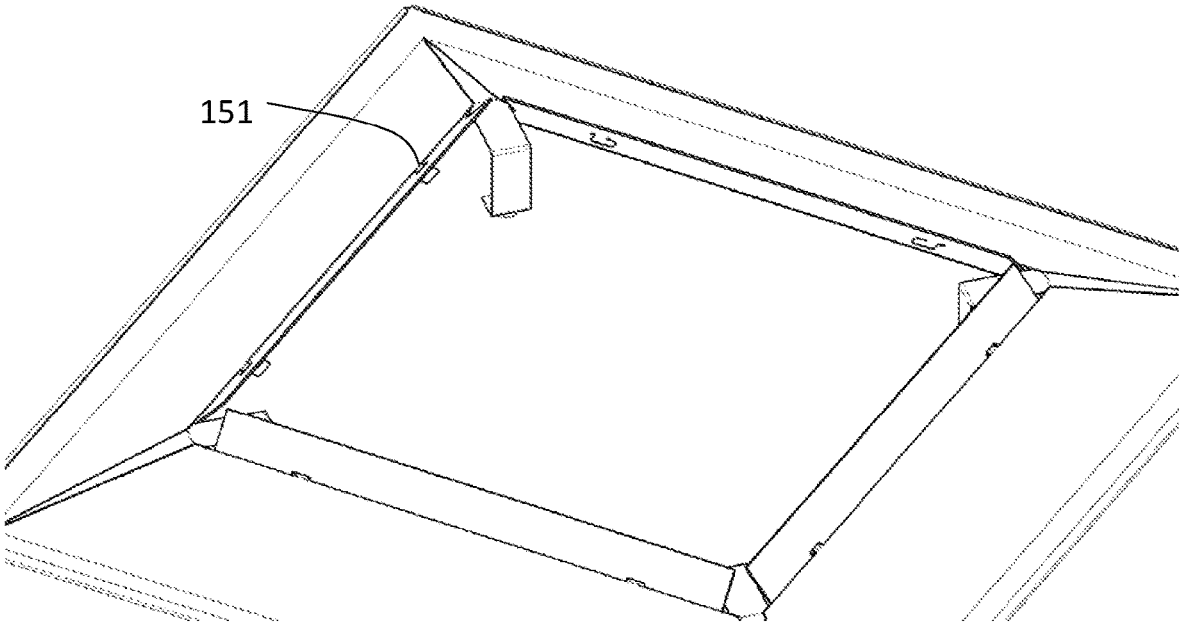

In the exemplary embodiment of FIGS. 5A and 5B, the hinge member 152 is a bent portion extending from the wall member 11. This provides a very simple solution, that may be accomplished by cutting and bending of a metal sheet. In the illustrated embodiment, the hinge 15 is formed by a substantially horizontal aperture 151 and a horizontal hinge member 152. For the purpose of further minimizing the point of contact between the flap 14 and the wall member 11 at the hinge 15, the hinge member 152 may e.g. be a sheet member projecting from the wall member 11, bent or twisted to assume a substantially vertical shape. That way, the point of contact in the hinge 15 will be an edge of the bent or twisted portion 152, and an edge of a corresponding vertical aperture 151 in the flap 14.

The terminal 10 as exemplified by embodiments herein is configured to be produced at low cost. In a preferred embodiment, the wall member 11 and the flange 111 are formed from a single sheet of metal, such as steel or aluminum. This means that with simple cutting and bending operations, the major part of the terminal 10 may be produced from a single element, at low production cost and high speed. Preferably also the hinge member 152 is formed from the same single sheet of metal. Each flap 14 may in one embodiment be provided by means of a flat element, such as a sheet of plastic or metal. It needs only cutting or molding to the desired shape and to form the hinge apertures 151. In an embodiment configured as shown in FIGS. 5A and 5B, where each flap 14 is hinged to a pair of hinge member 152, which are notched at facing edges, a flexible flap 14 of e.g. plastic may be bent to fit the hinge members 152 into the apertures 151, where after the flap 14 will flex back and be securely attached at the hinge as shown in FIGS. 5A and 5B.

In one embodiment, the wall member 11 may be configured with slanting portions as illustrated in the drawings. This may be accomplished by pressing out the shape from a flat metal sheet. In an alternative embodiment, slots 112 may be formed at corner positions, as can be seen e.g. in FIG. 3A, after which the wall members may be bent to form slanting portions. In one version of such an embodiment, a corner member 17 may be attached to cover the slot 112. This is depicted e.g. in FIGS. 4B and 5A. The corner element may be a metal or plastic member, e.g. attached by gluing to the wall member 11. The drawings illustrate a corner member 17 attached on the upper, i.e. outer, side of the slanted wall member 11, but a corner member 17 may alternatively or additionally be provided on the lower, i.e. inner, side of the wall member 11.

The deflector 12 preferably has a flat outer portion 122, and preferably also a flat lower side so as to accommodate well to the surface of the ceiling 4. In one embodiment, the deflector 12 may be configured as a flat sheet of e.g. metal or plastic, which, is detachably connectable to the wall member 11. This may e.g. be obtained by means of latches or screws (not shown). In one embodiment, magnets are employed for attaching the deflector to the wall member 11 of the terminal 10. In the exemplary embodiment of FIGS. 4B and 4C, a magnet 171 may be attached to the corner member 17, which corner member 17 is shaped to attach the deflector at the appropriate distance 121 from the wall member 11. In an embodiment where the deflector 12 is made of steel, magnets 171 provided at the corner members 171 may attached directly to an upper surface of the deflector. For a plastic embodiment, a magnetic attachment member may be attached to a predetermined position of the upper side of the deflector 12.

In various embodiments, a control unit 20 comprising electronics for e.g. processing or measuring airflow, temperature or other parameters, and potentially controlling an air valve (not shown) in the box 2, may be provided at the upper side of the deflector 12. This way it may be readily accessible for communication or maintenance. However, the deflector 12 does not in itself carry any parts related to the pivotable flaps 14. This means that a substantially smooth upper surface of the deflector 12 may be provided, which contributes to keeping a low noise level even at high airflows, and also prevents collection of dust.

Figure 6:
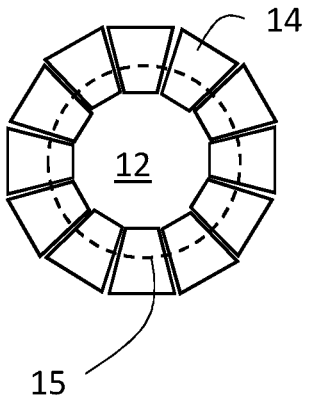
FIG. 6 schematically illustrates an arrangement of flaps in an embodiment of an air supply terminal configured with a circular cross-section.

The terminal 10 may take any shape, in terms of the cross-section of the opening 110. In the embodiments shown in FIGS. 3-5, the wall member 11 has two pairs of opposing wall sides, providing a rectangular shape to the opening 110. In such an embodiment, the terminal comprises four flaps 14 hinged to respective wall sides. In an alternative embodiment, the cross-section may e.g. be octagonal. FIG. 6 schematically illustrates parts of another embodiment of a terminal 10, configured with a cylindrical wall side, providing a circular shape to the opening 110. The terminal 10 may thus comprises three or more flaps 14, e.g. twelve flaps 14 as in the illustrated embodiment, connected by hinges 15 to the wall side at evenly distributed positions around the opening 110. In such an embodiment, adjacent flaps 14 may be spaced apart about the periphery of the wall member 11, or otherwise configured to partly overlap as they pivot under influence of the airflow through the terminal 10.

Figure 7:
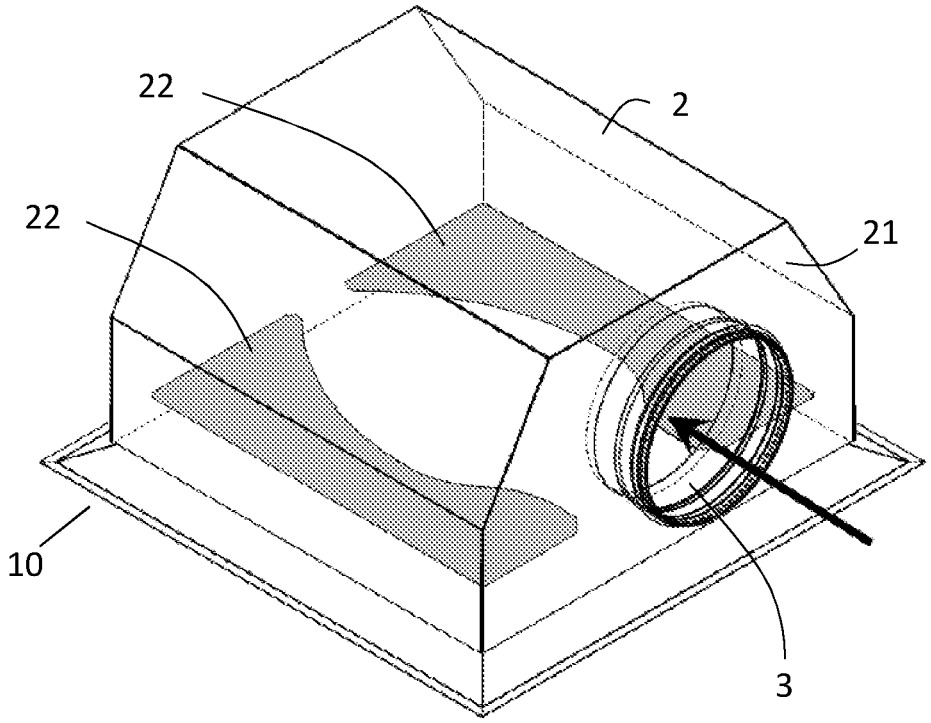
FIG. 7 schematically illustrates a supply air system comprising a sealed box having an outlet opening connected to a supply air terminal according to one embodiment.
Figure 8:
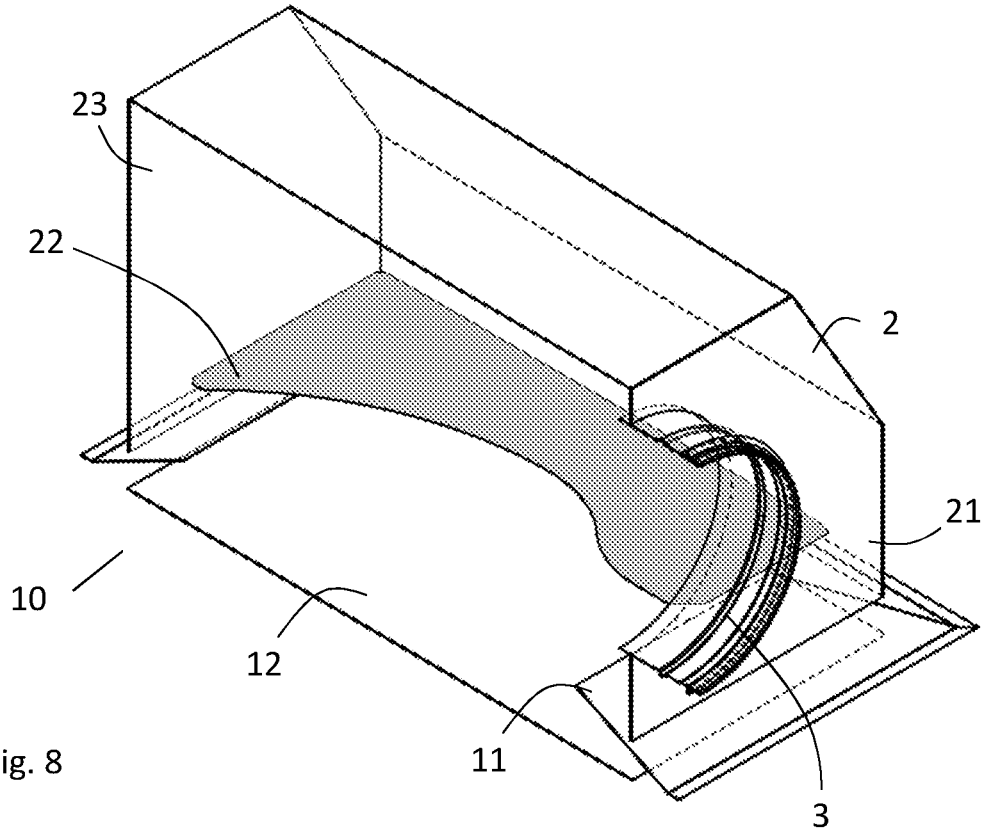
FIG. 8 illustrates a part of the embodiment of FIG. 7 in cross-section.
Figure 9:
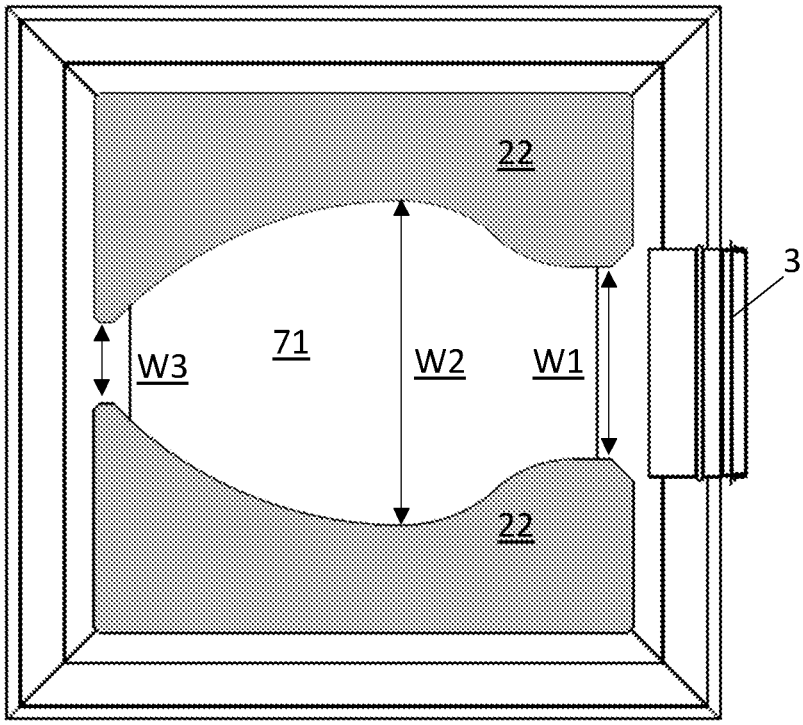
FIG. 9 illustrates the supply air system of FIG. 7 from a side opposite the outlet opening connecting to the supply air terminal.

FIGS. 7-9 illustrate an air supply system comprising a sealed box 2 connected to a supply air terminal 10, which terminal 10 may be configured according to any of the embodiments presented herein. The function of the supply air terminal is to provide suitable provision of air to a connecting room dependent on the airflow level provided to the terminal. A supply duct of a ventilation system may connect to the box 2 at an interface of an inlet opening 3 provided in a first wall 21 of the box 2. The box 2 has an opening 71 in a second wall 22 at its lower side, substantially perpendicular to the first wall 21, to which opening 71 the supply air terminal 10 is connected. A valve device for regulation of the airflow (not shown) may be arranged in the box 2, for regulating the airflow provided to the terminal 10, or otherwise in the duct system connecting to the box inlet opening 3.

The flaps 14 of the supply air terminal 10 are configured to prevent cool air from falling down from the terminal, by self-adjustment of the opening slit under the flaps. In various embodiments, the flaps 14 may also be used for reducing the air velocity in a certain direction, when two adjacent terminals 10 eject air towards each other. In such circumstances, the opposing flaps may e.g. be adapted by applying weights to the flaps 14, or by cutting the flaps.

Especially at larger air flows, it is important that an even air distribution is achieved in different directions, preferably all directions. Otherwise, collision of air from different terminals 10 may occur, designing ventilation systems will be greatly impaired. In a supply air system of FIGS. 7-9, air will typically flow into the box 2 through one side wall 21, for subsequent ejection through the lower wall 22. This may cause air to distribute unevenly. However, by careful design of the outlet opening 71 in the box 2, at which the terminal 10 is attached, substantial improvement has been obtained in terms of even distribution. The shape of the outlet opening 71 is formed to advantageously limit the area of the outlet. This shape may be obtained by providing flanges to side walls of the box 2, or by cutting out a preferred shape of the outlet opening 71 in a bottom wall of a box 2.

In a preferred embodiment, the outlet opening 71 runs between the first wall in which the inlet 3 is disposed, and an opposing wall 23. Moreover, the outlet opening 71 is as widest at a central part of the second wall 22 and narrows towards said first wall 21 and said third wall 23. Preferably, the contour of the outlet opening 71 arcs between the first wall 21 and the facing third wall 23.

In various embodiments, test have shown that further improved even distribution is obtained where the outlet opening 71 has smaller width at the opposing wall 23 than at the inlet wall 21. The outlet opening may have a first width W1 at the first wall 21, a second width W2 at a central part of the second wall 22, and a third width W3 at the third wall 23 facing the first wall, wherein said first width W1 is larger than said first third width W3. The second width W2 is larger than both the first width W1 and the third width W3.

Various embodiments have been presented and discussed above. It shall also be understood that features of those embodiments may be combined, where not contradicting. Th general design of the terminal, which provides an adjustable flap 14 that is not closed in its most restricting position, means that there is little risk for building up dirt at the surfaces of and surrounding the flap, and that there is substantially no risk for the flap 14 to get stuck in a certain position.

The embodiments shown are primarily configured for mounting at a ceiling 4. In one embodiment, one or more terminals 10 provided in a ceiling 4 may risk to eject air towards each other, if they are situated to close to each other or another object such as a wall. The result may be that cool air that has not yet been heated by mixing with the ambient air can be forced downwards into the room, causing a disadvantageous draught. In such a situation, one or potentially more flaps 14 may be locked in a vertical position, corresponding to the position of FIG. 1. This will restrict the airflow in that direction, to as to avoid the mentioned draught situation. Since only one flap 14 is locked, or maybe two flaps 14, out of e.g. four flaps 14 present in the illustrated embodiment, this will not lead to a high velocity ejection of air through the small slit 16 of the locked flap(s). Instead, the air will take the easiest way out through the remaining flaps 14 that are still pivotable.

Although the embodiments described herein are arranged for ceiling mounting, it should be understood that a supply air terminal as provided herein may alternatively be configured for mounting in a wall, preferably for ejecting air along a ceiling portion from the wall, and in such an embodiment the aperture may be configured as a straight slot rather than annular aperture. In addition, other embodiment falling within the scope of the appended claims will be conceivable based on the teachings of this disclosure.

The invention claimed is:

1. A supply air terminal for ceiling mounting, comprising a wall member surrounding an opening for connection to an air supply interface in the ceiling; a deflector connected at a distance from the wall member to face the opening, thereby forming an annular aperture between the wall member and the deflector, the deflector comprising a flat outer portion extending parallel to the ceiling; a plurality of flaps pivotably connected at a hinge to the wall member to hang down in the annular aperture such that an open slit is formed between an edge of each flap and the flat outer portion of the deflector, wherein the slits have a width which is self-adjusted by means of the flaps pivoting between a relaxed position and a high flow position under influence of the airflow through the terminal, and a minimum width of each slit is in a range of 5-20 mm when the flaps are in the relaxed position, and wherein air is always passing through the slit.

2. The supply air terminal of claim 1, wherein the flap edges are arranged radially inwardly of a perimeter of the deflector and at a first distance from the flat outer portion of the deflector in at least the relaxed position.

3. The supply air terminal of claim 2, wherein the flap edges are arranged radially outwardly of the perimeter of the deflector in the high flow position.

4. The supply air terminal of claim 1, wherein an outwards projecting flange is formed at an outer end of the wall member, which flange extends in a plane about the opening.

5. The supply air terminal of claim 4, wherein the flat outer portion of the deflector is parallel to and spaced apart vertically from the projecting flange.

6. The supply air terminal of claim 5, wherein the wall member and the flange are formed from a single sheet of metal.

7. The supply air terminal of claim 6, wherein said hinge comprises an aperture formed in the flap and a hinge member projecting from the wall member into the aperture, such that the flaps rests with an edge of the aperture against the projecting hinge member, and wherein said hinge member is formed from said single sheet of metal.

8. The supply air terminal of claim 7, wherein said hinge member is a bent portion extending from the wall member.

9. The supply air terminal of claim 4, wherein the opening formed by the wall member has a cross-section which increases from a position of said hinge towards said projecting flange.

10. The supply air terminal of claim 1, wherein each flap has a balancing portion for calibrating the position of center of gravity for the flap with respect to the position of the hinge.

11. The supply air terminal of claim 1, wherein said wall member has two pairs of opposing wall sides, providing a rectangular shape to the opening, the terminal comprising four flaps hinged to respective wall sides.

12. The supply air terminal of claim 1, wherein said wall member has a cylindrical wall side, providing a circular shape to the opening, the terminal comprising three or more flaps hinged to the wall side at evenly distributed positions around the opening.

13. The supply air terminal of claim 1, wherein said deflector is a flat sheet, detachably connectable to the wall member.

14. The supply air terminal of claim 1, wherein each flap is made from a flat sheet of plastic.

15. The supply air terminal of claim 1, wherein the flat outer portion of the deflector extends to the perimeter of the deflector.

* * * * *